US007962082B2

(12) United States Patent
Takahashi et al.

(10) Patent No.: US 7,962,082 B2
(45) Date of Patent: Jun. 14, 2011

(54) FIXING DEVICE, IMAGE FORMING APPARATUS, AND FIXING METHOD HAVING AN EXPANDING/CONTRACTING CONTACTING MEMBER

(75) Inventors: Toshiaki Takahashi, Kanagawa (JP); Hidehiko Fujiwara, Tokyo (JP); Manabu Nonaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 448 days.

(21) Appl. No.: 12/133,659

(22) Filed: Jun. 5, 2008

(65) Prior Publication Data

US 2009/0010688 A1 Jan. 8, 2009

(30) Foreign Application Priority Data

Jul. 6, 2007 (JP) ..... 2007-178562

(51) Int. Cl.
*G03G 15/20* (2006.01)

(52) U.S. Cl. ..... 399/328; 399/329; 399/45; 219/216

(58) Field of Classification Search ..... 299/328, 299/329, 45; 219/216; 399/328, 329, 45
See application file for complete search history.

(56) References Cited

U.S. PATENT DOCUMENTS 6,151,466 A 11/2000 Fujiwara
6,542,712 B2 4/2003 Kamijo et al.
6,643,490 B2 * 11/2003 Regimbal ..... 399/329
6,731,900 B2 5/2004 Takenaka et al.
6,731,902 B2 5/2004 Takenaka et al.
6,788,916 B2 9/2004 Takenaka et al.
6,801,744 B2 10/2004 Fujiwara et al.
6,907,218 B2 6/2005 Fujiwara et al.
7,013,108 B2 3/2006 Takenaka et al.
2004/0151515 A1 * 8/2004 Nakayama ..... 399/67
2004/0253027 A1 * 12/2004 Kato et al. ..... 399/328
2005/0047809 A1 * 3/2005 Kunimori ..... 399/45
2005/0220473 A1 * 10/2005 Bott et al. ..... 399/67
2008/0012208 A1 1/2008 Fujiwara et al.
2009/0016792 A1 * 1/2009 Yamada et al. ..... 399/331
2009/0116884 A1 * 5/2009 Nonaka et al. ..... 399/328
2009/0148207 A1 * 6/2009 Yamada et al. ..... 399/331
2010/0310289 A1 * 12/2010 Someya et al. ..... 399/329

FOREIGN PATENT DOCUMENTS

JP 2000-206826 7/2000
JP 2001-356621 12/2001
JP 2002-6656 1/2002
JP 2003-337484 11/2003

* cited by examiner

*Primary Examiner* — David M Gray
*Assistant Examiner* — G. M. Hyder
(74) *Attorney, Agent, or Firm* — Oblon, Soivak, McClelland, Maier & Neustadt, L.L.P.

(57) ABSTRACT

When an infra-red heater is to be taken out from a fixing device for maintenance of the infra-red heater, screw-fastening is first released and one holder is extracted from a holding member. The infra-red heater is then pulled out from the side the holder was extracted from. This process is then reversed when a new or repaired infra-red heater is to be mounted on the fixing device. There is a pressure member in pressure contact with a flexible fixing member. The surface area of the contacting member facing the pressure member is variable.

15 Claims, 7 Drawing Sheets

FIXING DEVICE, IMAGE FORMING APPARATUS, AND FIXING METHOD HAVING AN EXPANDING/CONTRACTING CONTACTING MEMBER

CROSS-REFERENCE TO RELATED APPLICATIONS

The present application claims priority to and incorporates by reference the entire contents of Japanese priority document 2007-178562 filed in Japan on Jul. 6, 2007.

BACKGROUND OF THE INVENTION

1. Field of the Invention

The present invention relates to an image-forming apparatus and to a fixing device for use in the image-forming apparatus.

2. Description of the Related Art

On-demand fixing devices of which a start-up time is short are well-known. An on-demand fixing device includes a fixing film (endless film) as a fixing member, a pressure roller (pressure member), and a heater (heating unit) such as a ceramic heater. The fixing film is sandwiched between the heater and the pressure roller, and the fixing film is heated with the heater. When a recording medium with a toner image thereon passes through a nip section between the heater and the pressure roller, the recording medium is subjected to heat and pressure at the nip section, whereby the toner image is fixed to the recording medium. Such a technology has been disclosed, for example, in Japanese Patent Publication Laid-open No. 2002-6656.

On the other hand, Japanese Patent Publication Laid-open No. 2003-337484 discloses technology where heating bodies are provided on either surface of a heater board at a film-heating heating apparatus. One heating body is shorter than the other heating body. A current is supplied to only the shorter heating body when a small-sized paper passes. This prevents increases in temperature at the paper-feed portions.

Further, Japanese Patent Publication Laid-open No. 2001-356621 and Japanese Patent Publication Laid-open No. 2000-206826 disclose a technology where, in a film-heating heating apparatus, a second temperature detection element for sensing increase in temperature at sections where paper does not pass is housed within a housing at sections where the paper does not pass. This prevents a heating body or heating member etc. from degrading or breaking down as a result of increases in temperature at sections outside of where the paper passes when a recording material of the minimum width passes.

With the conventional on-demand fixing device such as that disclosed in Japanese Patent Publication Laid-open No. 2002-6656, the ease with which a heating unit such as a heater can be changed (ease of maintenance) is poor. This is explained in detail below.

The lifespan of the heater is finite, and maintenance to replace the heater is performed regularly. However, the heater is in contact with the pressure roller via the fixing film. This makes it difficult to pull out the heater in a lateral direction (longitudinal direction) as is in a state where pressure is applied.

In order to resolve this situation, one approach could be to provide a mechanism for releasing pressure between the heater (the fixing film) and the pressure roller before pulling out the heater. In other words, the heater can be pulled out from the apparatus after releasing the pressure between the heater and the pressure roller by manipulating the mechanism for releasing pressure. Providing a pressure release mechanism in such situations does, however, incur extra costs and require more space.

In particular, pressure is always applied to the heater by the pressure member in the conventional on-demand fixing device. This means that it is easy for the heater to be damaged when there is a paper jam or during transportation.

Further, when a recording medium of a width smaller than the maximum size for which paper is passed through is fed through (hereinafter "small size paper") with the on-demand method fixing device of Japanese Patent Publication Laid-open No. 2003-337484, Japanese Patent Publication Laid-open No. 2001-356621, and Japanese Patent Publication Laid-open No. 2000-206826, heat is not dissipated by the recording medium at parts that the paper is not fed through. Sections that the paper is not fed through therefore reach high temperatures compared with sections that the paper is fed through. When increases in temperature at sections where paper is not fed through worsen, a heater, a heater stay, a fixing film, and a pressure roller are also damaged. This can also result in the degradation of the image quality. In particular, when a thick recording medium (referred to as small size thick paper such as cardboard and envelopes) smaller in width than the maximum size is transported and fed, large quantity of heat is dissipated to the recording medium at paper-feed portions. Temperature control is then performed based on the output of temperature detection elements provided at the paper-feed portions. The quantity of electrical power supplied to the heater is therefore substantial. On the other hand, heat is not dissipated by recording material at sections where paper is not fed through. The temperature therefore becomes high and there is the possibility of damage to the heater, the heater stay, the fixing film, and the pressure roller.

SUMMARY OF THE INVENTION

It is an object of the present invention to at least partially solve the problems in the conventional technology.

According to an aspect of the present invention, there is provided a fixing device including a flexible fixing member that heats and fuses a toner image to a recording medium, the fixing member having a hollow portion; a pressure member that is in pressure contact with the fixing member; a contacting member that makes contact with the pressure member via the fixing member and that is arranged in the hollow of the fixing member; and a heating member configured to heat the contacting member. The heating member is disposed so as to be capable of being inserted into and detached from the hollow in a state where the contacting member makes contact with the pressure member via the fixing member, and a surface area of a surface of the contacting member facing the pressure member is variable.

According to another aspect of the present invention, there is provided an image forming apparatus including the above fixing device.

According to still another aspect of the present invention, there is provided a fixing method implemented in a fixing device for fixing a toner image to a recording medium. The fixing device including a flexible fixing member that heats and fuses a toner image to a recording medium, the fixing member having a hollow portion; a pressure member that is in pressure contact with the fixing member; a contacting member that makes contact with the pressure member via the fixing member and that is arranged in the hollow of the fixing member; and a heating member configured to heat the contacting member. The fixing method including disposing the heating member so as to be capable of being inserted into and detached from the hollow in a state where the contacting member makes contact with the pressure member via the fixing member, and adjusting a surface area of a surface of the contacting member facing the pressure member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
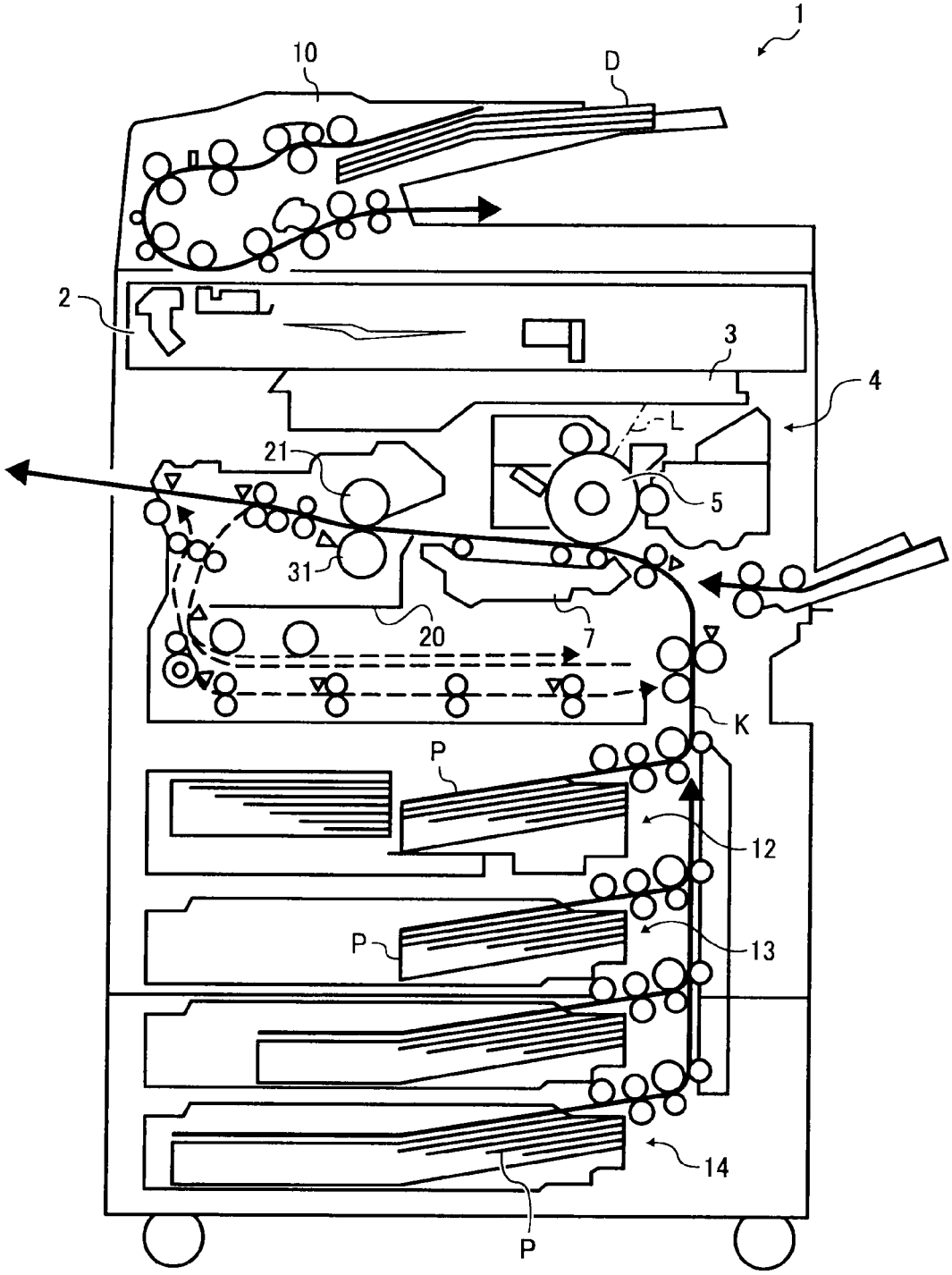
FIG. 1 is an outline side-view of an overall structure of an image forming apparatus according to an embodiment of the present invention.

Exemplary embodiments implementing the present invention are explained in the following with reference to practical examples shown in the drawings. In the drawings, like parts are denoted by like reference numerals, and explanations thereof will be appropriately simplified or omitted.

An explanation is given of a first embodiment of the present invention using FIGS. 1 to 7. First, an explanation is given of an overall structure and operation for an image forming apparatus using FIG. 1. In FIG. 1, numeral 1 is an apparatus body for a copier that is an image forming apparatus, numeral 2 is an original document reader that optically reads in image information for an original document D, numeral 3 is an exposure unit that irradiates the top of a photosensitive drum 5 with exposing light L based on image information read in by the original document reader 2, numeral 4 is a forming unit that forms a toner image (image) on the photosensitive drum 5, numeral 7 is a transfer unit that transfers a toner image formed on the photosensitive drum 5 onto a recording medium P, numeral 10 is an original document transport unit that transports the installed original document D to the original document reader 2, numerals 12 to 14 are paper-feed units that store the recording medium P such as transfer paper, numeral 20 is fixing device that fixes as-yet-unfixed images onto the recording medium P, numeral 21 is a fixing film that is a fixing member disposed at the fixing device 20, and numeral 31 is a pressure roller that is a pressure member disposed at the fixing device 20.

First, an explanation is given of the operation during normal image forming at the image forming apparatus. The original document D is transported from an original document table in the direction of the arrows of the drawing by transport rollers of the original document transport unit 10 and passes above the original document reader 2. Image information for the original document D passing above is then optically read by the original document reader 2. Optical image information read by the original document reader 2 is converted into an electrical signal and then sent to the exposure unit 3 (writing unit). The exposure unit 3 then emits exposure light L such as laser light in the direction of the photosensitive drum 5 of the forming unit 4 based on the image information for the electrical signal.

On the other hand, at the forming unit 4, the photosensitive drum 5 is rotated in a clockwise direction in the drawing. Predetermined production processes (electrification process, exposure process, developing process) are then performed to form an image (toner image) corresponding to the image information on the photosensitive drum 5. The image formed on the photosensitive drum 5 is then transferred onto the recording medium P at the transfer unit 7 using a registration roller.

The recording medium P is treated at the transfer unit 7 in the following manner. First, one paper-feed unit of the paper-feed units 12 to 14 of the apparatus body 1 is selected automatically or manually (for example, paper-feed unit 12 that is the uppermost level is selected). The uppermost sheet of the recording medium P stored in the paper-feed unit 12 is then transported towards the position of the transport path K. The recording medium P then passes through the transport path K and reaches the position of the registration roller. The recording medium P that has reached the position of the registration roller is then transported towards the transfer unit 7 with a timing so that the position of the recording medium P coincides with the image formed on the photosensitive drum 5.

Once the transfer process is complete, the recording medium P passes the position of the transfer unit 7. The recording medium P then passes through the transport path and reaches the fixing device 20. The recording medium P that has reached the fixing device 20 is sent between the fixing film 21 and the pressure roller 31. An image is then fixed to the recording medium P as a result of the recording medium P being subjected to heat from the fixing film 21 and pressure from both the fixing film 21 and the pressure roller 31. The recording medium P with the fixed image is then sent from between the fixing film 21 and the pressure roller 31 (the nip section) and ejected from the apparatus body 1. The series of image forming processes is then complete.

Figure 2:
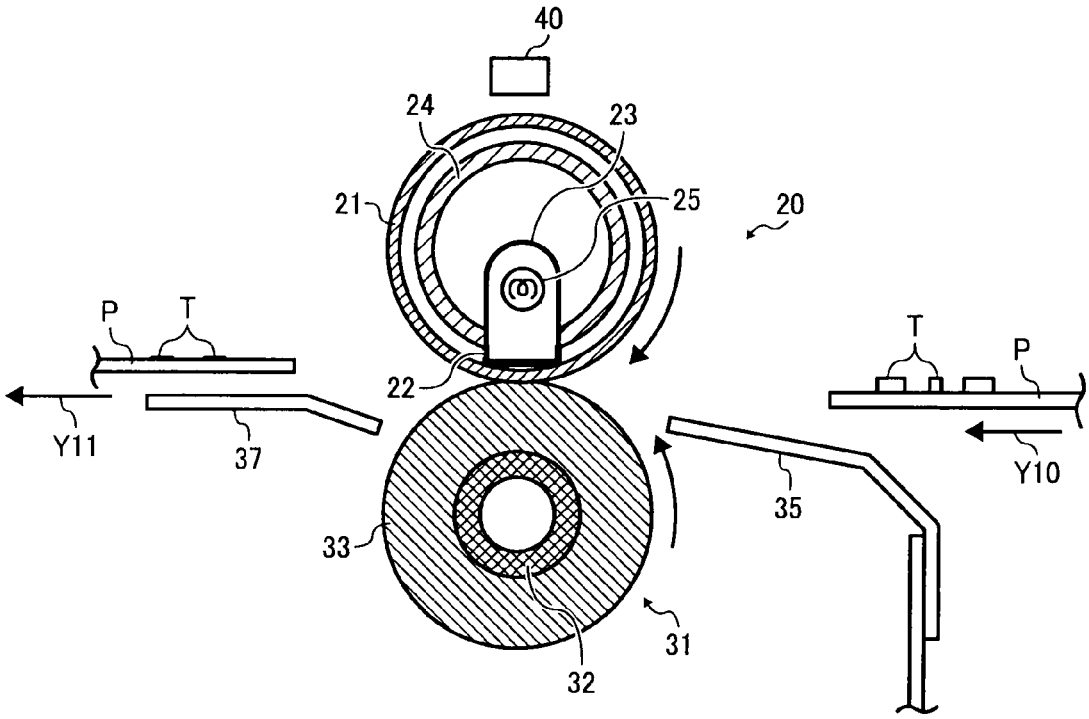
FIG. 2 is a schematic diagram showing a fixing device shown in FIG. 1.
Figure 3:
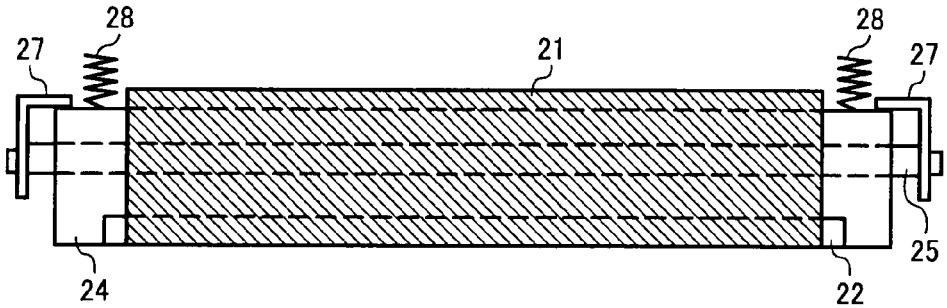
FIG. 3 is a partial side view of the fixing device.
Figure 4:
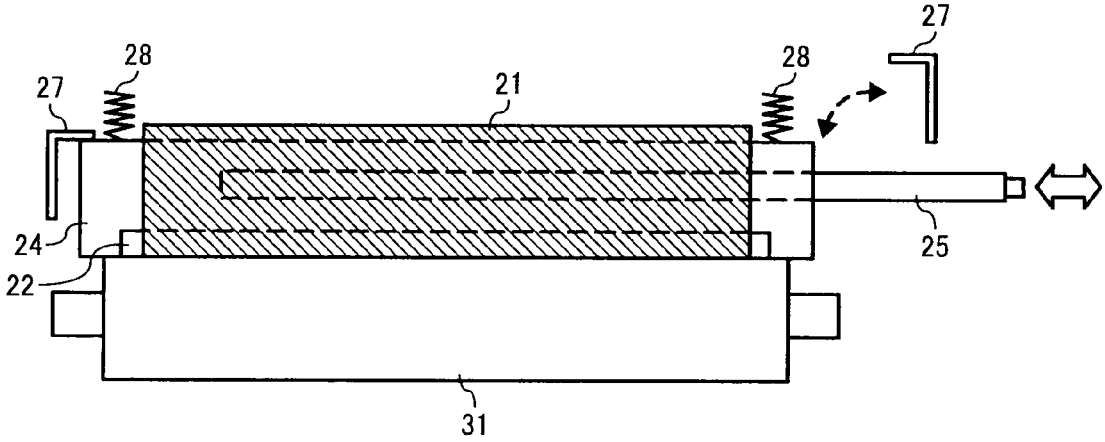
FIG. 4 is a view of an infra-red heater inserted into and detached from the fixing device.
Figure 5:
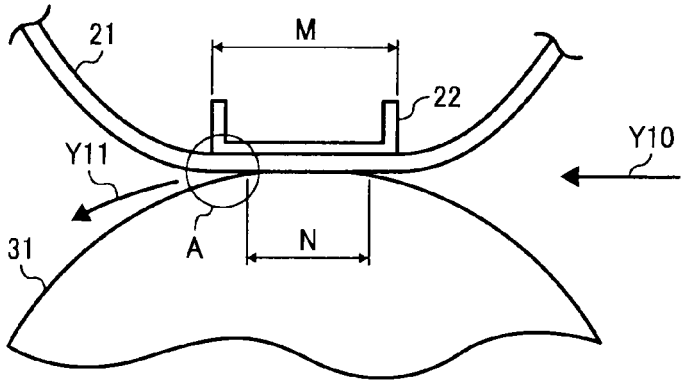
FIG. 5 is a partial enlarged view showing the vicinity of a nip section of the fixing device.
Figure 6:
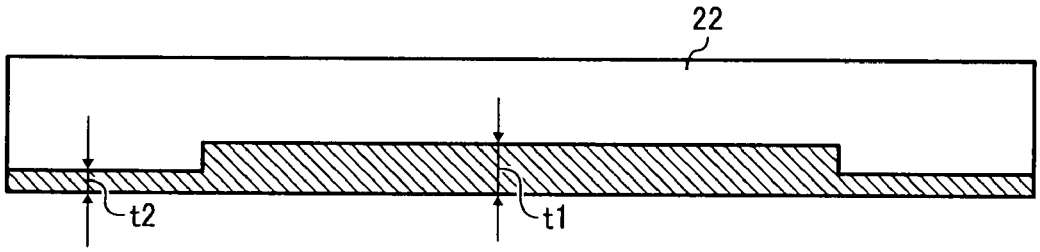
FIG. 6 is a side view showing a heating plate.
Figure 7:
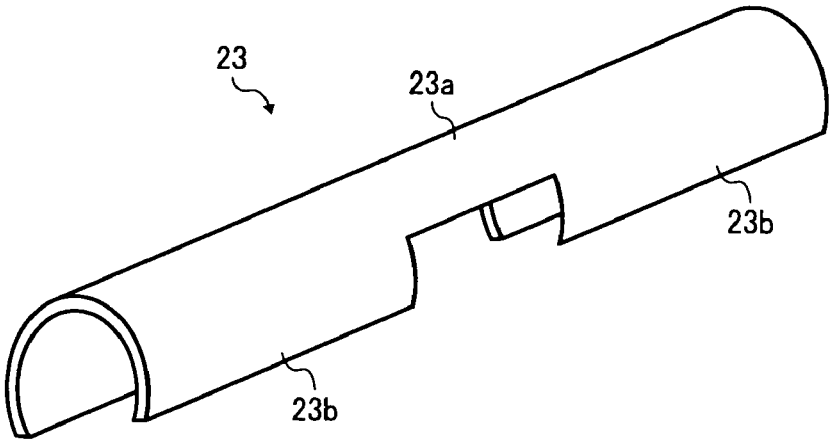
FIG. 7 is a side view showing a reflecting plate.

Next, an explanation is given using FIG. 2 to FIG. 7 of a structure and operation for the fixing device 20. FIG. 2 is a schematic diagram showing the fixing device 20. FIG. 3 is partial view of the fixing device 20 viewed only in a lateral direction. FIG. 4 is a view showing a state where an infra-red heater 25 that is a heater unit is inserted into and detached from the fixing device 20. FIG. 5 is a partially enlarged view showing the vicinity of a nip section of the fixing device 20. FIG. 6 is a view of a heating plate 22 taken as a contacting member viewed only in a lateral direction. FIG. 7 is a view of a reflecting plate 23 taken as a reflecting member viewed only in a lateral direction.

As shown in FIG. 2, the fixing device 20 includes the fixing film 21 that is a fixing member, the heating plate 22 that is a contacting member, the reflecting plate 23 that is a reflecting member, a holding member 24, the infra-red heater 25 that is a heating unit, the pressure roller 31 that is a pressure member, an optical sensor 40 that is a detection unit, and guide plates 35, 37.

The fixing film 21, which the fixing member, is a thin, endless, flexible film that rotates in the direction of an arrow in FIG. 2 (clockwise direction). Polyimide, polyamide, fluroresin, and metal etc. can be used as the material for the fixing film 21. It is also possible to form a peeling layer of PFA (tetrafluoroethylene perfluoroalkylvinylether copolymer resin), polyimide, polyetherimide, PES (poly ether sulfide) on the surface of the fixing film 21 to ensure separation (peeling) from the toner T (toner image). It is therefore possible to provide an on-demand fixing device where the start time is short by using the fixing film 21 of a low heat capacity. The infra-red heater 25 (heating unit), the heating plate 22, the reflecting plate 23, and the holding member 24 are fixed at the inside (inner peripheral surface side) within the fixing film 21. The fixing film 21 is pressurized by the heating plate 22 and forms a nip section with the pressure roller 31.

The heating plate 22, which is the contacting member, is a metal plate (or a ceramic or polyimide resin member) in the order of 0.1 millimeters thick. The heating plate 22 is heated by the infra-red heater 25 (heated by radiant heat) and forms a predetermined nip section by coming into contact with the pressure roller 31 via the fixing film 21. In the first embodiment, an opposing surface (surface facing the pressure roller 31) of the heating plate 22 is formed in the shape of a plane. This causes the shape of the nip section to be substantially parallel with respect to an image surface of the recording medium P. Fixing performance is therefore improved because adherence between the fixing film 21 and the recording medium P is high. This also reduces the likelihood of curling and creasing occurring at the recording medium P passing through the nip section. The curvature of the fixing film 21 at an output side of the nip section is large. This means that the recording medium P sent from the nip section can be easily separated from the fixing film 21.

Further, the heating plate 22 is coated with a fluororesin at a surface that makes sliding contact with the fixing film 21. Abrasion of an inner surface of the fixing film 21 making sliding contact with the heating plate 22 fixed so as to be supported at the fixing device 20 can therefore be alleviated.

The infra-red heater 25, which is the heating unit, is a carbon heater or halogen heater. The ends of the infra-red heater 25 are fixed to side plates of the fixing device 20 via the holding member 24. The output of the infra-red heater 25 is controlled by a power supply unit of the apparatus body 1. The heating plate 22 is then heated by the infra-red heater 25. The fixing film 21 is then in turn heated by the heating plate 22. This in turn results in the toner image T on the recording medium P being heated by the surface of the fixing film 21. The output of the infra-red heater 25 can be controlled based on film surface temperature detection results from a temperature sensor (not shown) facing the surface of the fixing film 21. Further, it is possible to set the temperature (fixing temperature) of the fixing film 21 to a desired temperature by controlling the output of the infra-red heater 25. The infra-red heater 25 (heating unit) is disposed so as to be insertable to and detachable from the fixing device 20 in a state where the heating plate 22 makes contact with the pressure roller 31 via the fixing film 21. This is explained in the following using FIG. 4.

When a carbon heater is used as the infra-red heater 25, the degree of freedom regarding on/off control is increased compared to using a halogen heater. Specifically, the passage of electric current is not cut before the duty ratio of the infra-red heater 25 reaches one hundred percent even when control to turn the heater off is repeated. Reduction in output with the passage of time can therefore be alleviated. When a carbon heater is used, it is preferable to optimize the shape in such a manner that the amount of radiant heat emitted in a direction facing the heating plate 22 (vertical direction in FIG. 2) is greater than an amount of radiant heat emitted in a direction orthogonal to the direction facing the heating plate 22 (a lateral direction of FIG. 2). It is therefore possible to focus the direction of heat generated by the infra-red heater 25 towards the heating plate 22 and the heating efficiency of the heating plate 22 can be increased.

The reflecting plate 23, which is the reflecting member, is disposed on the opposite side with respect to the infra-red heater 25 to the side facing the heating plate 22 (above the infra-red heater 25 in FIG. 2). The reflecting plate 23 is made of aluminum that is given a mirrored finish and reflects infra-red light emitted by the infra-red heater 25. The heating efficiency of the heating plate 22 increases because a large part of the infra-red light reflected by the reflecting plate 23 is made incident to the heating plate 22. In the first embodiment, the reflecting plate 23 is disposed at a position away from the infra-red heater 25 but can also be implemented through the metal plating or evaporation of aluminum at a part of a glass tube of the infra-red heater 25 (on the opposite side to the side facing the heating plate 22). The heating efficiency of the heating plate 22 can also be increased in this case because the glass plated with gold or evaporated with aluminum functions as a reflecting member.

It is also possible to provide an absorbing member that absorbs infra-red rays at a surface facing the heating plate 22 (on a side facing the infra-red heater 25). This can be achieved by applying black paint to the surface facing the heating plate 22. This increases the rate of absorption of infra-red rays at the heating plate 22 and increases the rate of heating the heating plate 22.

Explaining with reference to FIG. 3, the holding member 24 temporarily holds the heating plate 22, the infra-red heater 25, and the reflecting plate 23. The holding member 24 is made of heat-resistant resin material. The ends of the holding member 24 are supported by side plate of the fixing device 20. The infra-red heater 25 is supported at the holding member 24 via holders 27 taken as a second holding member. The holders 27 are then fastened using screws at the ends in a lateral direction of the holding member 24. A hole engaging with an end of the infra-red heater 25 is provided at each of the holders 27. Just the infra-red heater 25 can then be detached from the holding member 24 (the fixing device 20) by removing the holders 27 from the holding member 24.

Compression springs 28 are disposed at both ends in a lateral direction of the holding member 24. The heating plate 22 that is the contacting member is therefore urged towards the pressure roller 31 and the desired nip section is formed. The pressure roller 31 is disposed in a freely rotatable manner via a bearing at a plate-side (fixed position) of the fixing device 20. The pressure roller 31 is then rotated in a predetermined direction by a drive motor (not shown). The fixing film 21 is then driven in the direction of an arrow of FIG. 2 as a result of frictional force with the pressure roller 31.

A drive mechanism and pressure mechanism for the fixing device 20 can therefore be simplified.

The holding member 24 is formed so as to guide the fixing film 21, as shown in FIG. 2. Namely, the holding member 24 is cylindrical so as to maintain a circular posture for the flexible fixing film 21. This alleviates degradation and breakdown of the shape of the fixing film 21.

Referring to FIG. 2, the pressure roller 31, which is a pressure member, is a resilient layer 33 on a core 32. The resilient layer 33 of the pressure roller 31 is formed from a material such as fluoro-rubber, silicone rubber, or foamable silicone rubber, etc. It is also possible to provide a thin moldreleasing layer (tube) of PFA etc. at the surface of the resilient layer 33. The pressure roller 31 presses against the fixing film 21 and a desired nip section is formed between the pressure roller 31 and the fixing film 21. The pressure roller 31 is then rotated in the direction of an arrow in FIG. 2 (anti-clockwise direction) by a drive mechanism (not shown).

The guide plate 35 (entry guide plate) that guides the recording medium P transported in the direction of the nip section is disposed at the entry side of the contacting section (at the nip section) of the fixing film 21 and the pressure roller 31. The guide plate 37 (exit guide plate) that guides the recording medium P sent from the nip section is disposed at the exit side of the nip section. The guide plates 35, 37 are fixed to a frame (casing) of the fixing device 20.

The fixing device 20 operates as follows. When a power switch of the apparatus body 1 is turned on, power is supplied to the infra-red heater 25 and rotation of the pressure roller 31 in the direction of an arrow in FIG. 2 commences. The fixing film 21 is therefore also driven (rotated) in the direction of an arrow in FIG. 2 due to frictional force with the pressure roller 31.

A recording medium P is then fed from any of the paper-feed units 12 to 14. An as-yet unfixed image is then held on the recording medium P at the forming unit 4. The recording medium P holding the as-yet unfixed image T (toner image) is transported in the direction of an arrow Y10 of FIG. 2 while being guided by the guide plate 35. The recording medium P is therefore sent to the nip section of the fixing film 21 and the pressure roller 31 that are pressed together. The toner image T is then fixed to the surface of the recording medium P as a result of heating by the fixing film 21 heated by the heating plate 22 and pressure applied by the heating plate 22 (the fixing film 21) and the pressure roller 31. The recording medium P holding the fixed image is then transported in the direction of an arrow Y11.

The following is a detailed explanation with reference to FIG. 4 of features of the structure and operation of the fixing device 20. In the first embodiment, the infra-red heater 25 can be inserted into and detached from the fixing device 20 without being released from the pressure of the members 21, 22, 31 in a state where the heating plate 22 makes contact with the pressure roller 31 via the fixing film 21. When the holders 27 (the second holding member) are detached from the holding member 24, the infra-red heater 25 is detached from the fixing device 20.

Specifically, when the infra-red heater 25 is to be extracted from the fixing device 20 for maintenance of the infra-red heater 25, screw-fastening is first released and one holder 27 is extracted from the holding member 24 (movement in the direction of dashed arrows of FIG. 4). The infra-red heater 25 is then pulled out from the side the holder 27 was extracted from (movement in the direction of the white arrow of FIG. 4 to the right side of FIG. 4). When a new infra-red heater 25 (or a repaired infra-red heater 25) is to be mounted on the fixing device 20, an operation that is the reverse operation of the extraction operation is carried out. The time taken for the fixing device 20 according to the first embodiment to start up is extremely short. It is also not necessary to provide a mechanism for releasing the pressure of the heating plate 22 (fixing film 21) and the pressure roller 31. The ease with which the frequently changed infra-red heater 25 can be changed is therefore improved with a comparatively simple and straightforward structure and the ease of maintenance is also improved.

In this embodiment, the infra-red heater 25 is provided with clearance from the heating plate 22 (contacting member). Namely, the infra-red heater 25 is disposed with a gap of a certain extent intervening from the heating plate 22. It is therefore possible to alleviate the extent to which the infra-red heater 25 is subjected to vibration directly from the heating plate 22 even in cases such as when the fixing device 20 is transported with the heating plate 22 in contact with the pressure roller 31 via the fixing film 21. This prevents the infra-red heater 25 from becoming damaged. The shock incurred directly by the infra-red heater 25 from the nip section as a result of the jam processing operation is alleviated even when a jammed recording medium P is extracted at the position of the fixing device 20 in a state where the heating plate 22 is in contact with the pressure roller 31 via the fixing film 21 (when dealing with a jam). This means that damage to the infra-red heater 25 can be prevented.

Further, as shown in FIG. 5, the length M in the direction of transportation of the recording medium of the heating plate 22 (contacting member) is, for example, set to be longer than a nip N of the nip section (M>N). As a result, on the exit side of the nip section (region A in FIG. 5), the fixing film 21 is transformed to a raised shape on the pressure roller 31-side so as to coincide with the shape of the pressure roller 31. After the fixing process, the recording medium P is sent in a direction of separation from the fixing film 21 (the direction of arrow 11 in FIG. 5). The transport separation when sending the nip section can therefore be increased.

Moreover, as shown in FIG. 6, the heating plate 22 (contacting member) is formed so that, for example, a thickness t1 in a lateral direction of a central part (thickness in a direction facing the infra-red heater 25) and a thickness t2 at both ends in a lateral direction are different. Specifically, the thickness t1 of the central part in a lateral direction is formed thicker than the thickness t2 of the ends in a lateral direction (t1>t2). This means that the heating efficiency of the ends of the heating plate 22 in a lateral direction is greater than the heating efficiency of the central part of the heating plate 22 in the lateral direction. It is therefore possible to suppress malfunctions caused by lowering in the temperature at the ends as a result of heat being dissipated from the ends of the heating plate 22. Namely, the temperature distribution in a lateral direction of the heating plate 22 is uniform and occurrences of uneven fixing are reduced.

Moreover, the thickness t2 of the ends of the heating plate 22, for example, is made thinner than the thickness t1 of the central part of the heating plate 22. When the nipping amount of the central part becomes small compared with the nipping amount of the ends so that the ability of the central part to fix becomes small, or when the size in a lateral direction is such that the temperature at the ends rises when a lot of small-sized paper passes through, it is possible to make the thickness t1 of the central part thinner than the thickness t2 of the ends. The heating efficiency of the central part can then be made higher than the heating efficiency of the ends.

Further, as shown in FIG. 7, for example, the reflecting plate 23 (reflecting member) is formed so that the size at a central portion 23*a* of the reflecting plate 23 in a lateral direction (surface area of the surface facing the infra-red heater 25) and the size at end portions 23*b* in the lateral direction are different. Specifically, the central portion 23*a* is smaller than the end portions 23*b*. Therefore, the quantity of infra-red rays reflected by the reflecting plate 23 at the end portions 23*b* is greater than for the central portion 23*a*. This means that the heating efficiency of the end portions of the heating plate 22 in a lateral direction is greater than the heating efficiency of a central portion of the heating plate 22 in the lateral direction. It is therefore possible to suppress malfunctions caused by lowering in the temperature at the end portions as a result of heat being dissipated from the end portions of the heating plate 22. Namely, the temperature distribution in a lateral direction of the heating plate 22 is made uniform and occurrences of uneven fixing are reduced by employing such a structure.

In the first embodiment, the amount of infra-red light reflected by the end portions 23*b* of the reflecting plate 23 is greater than the amount of infra-red light reflected by the central portion 23*a* as a result of the surface area of the surface facing the reflecting plate 23. It is also possible to make the quantity of infra-red rays reflected by the end portions 23*b* of the reflecting plate 23 greater than reflected by the central portion 23*a* in the lateral direction even when the reflectivity with respect to infra-red rays at the end portions of the reflecting plate 23 is greater than at the central portion. It is also possible in this case to obtain the same results as explained above. The difference in reflectivity at the reflecting plate 23 can be set using materials of different reflectivity or by adjusting the extent of a mirrored finish.

The end portions 23*b* of the reflecting plate 23 are made larger than the central portion 23*a* to take into consideration heat dissipation from the end portions of the heating plate 22. Because of such a structure, however, the nipping amount of the central portion disadvantageously becomes smaller compared with the nipping amount of the end portions so that the image fixing ability of the central portion becomes smaller than the end portions. Moreover, the temperature at the end portions can disadvantageously rise higher than that of the central portion when a lot of small-sized paper passes through. To avoid such issues, it is possible to make the central portion 23*a* of the reflecting plate 23 larger than the end portions 23*b* to increase the heating efficiency of the central portion 23*a* as compared to the end portions 23*b*.

Moreover, as shown in FIG. 2, the optical sensor 40 is arranged as a detection unit at a position facing the outside surface of the fixing film 21. The optical sensor 40 optically detects a marker (for example, a white marker formed on a black fixing film) formed on the fixing film 21 and detects rotational speed (drive speed) of the fixing film 21. An encoder etc. can be used as a detecting unit.

Furthermore, a drive motor that drives the pressure roller 31 is such that it can vary the rotational speed of the pressure roller 31. The drive motor therefore functions as a varying unit that varies the drive speed of the fixing film 21. The drive motor that is the varying unit is then controlled based on the detection results detected by the optical sensor 40 so as to ensure that the rotational speed of the fixing film 21 is stable. Fluctuation in rotational speed of the fixing film 21 is therefore reduced. It is therefore possible to stabilize the fixing of the output image and the carrying of the recording medium P.

When a value detected by the optical sensor 40 is a predetermined value or less, there is the possibility of a slip occurring when rotatably driving the fixing film 21 and of localized rises in temperature occurring at the fixing film 21. The supply of power to the infra-red heater 25 is therefore interrupted. It is therefore possible to prevent thermal damage to the fixing film 21 even when an abnormal drive operation occurs.

Figure 8:
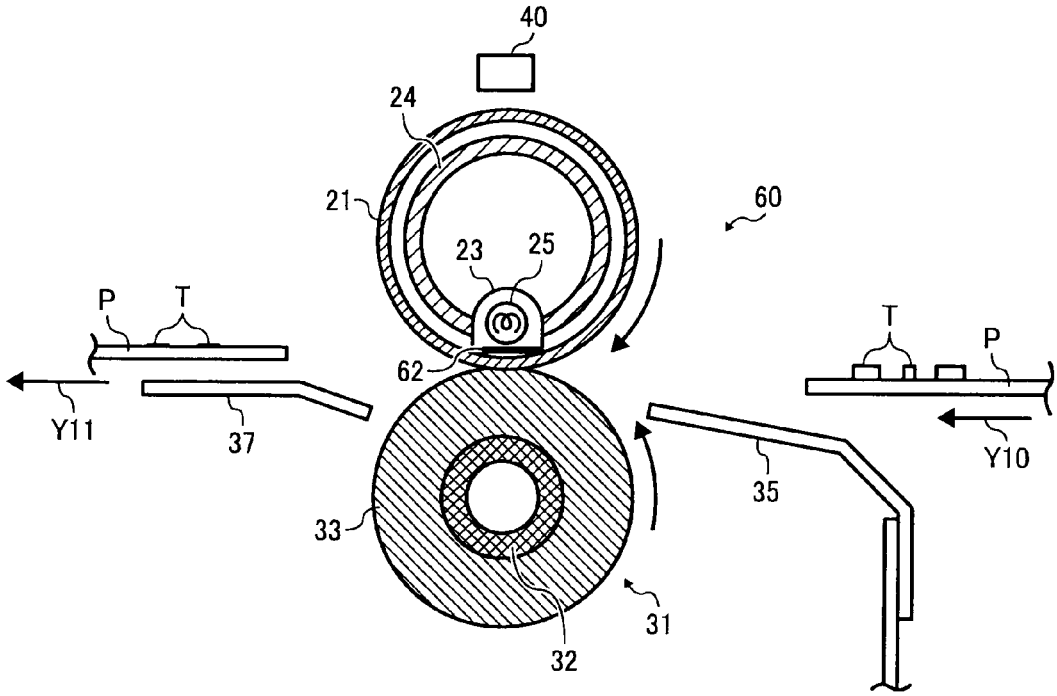
FIG. 8 is a schematic diagram showing a fixing device according to a second embodiment of the present invention.
Figure 9:
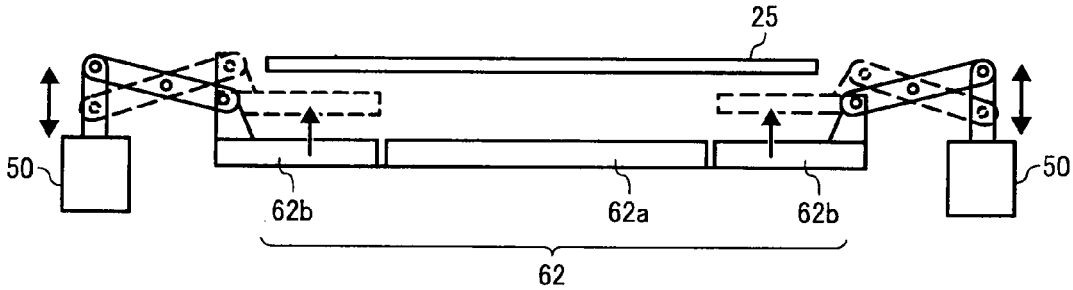
FIG. 9 is a schematic diagram of a heating plate shown in FIG. 8.
Figure 10A:
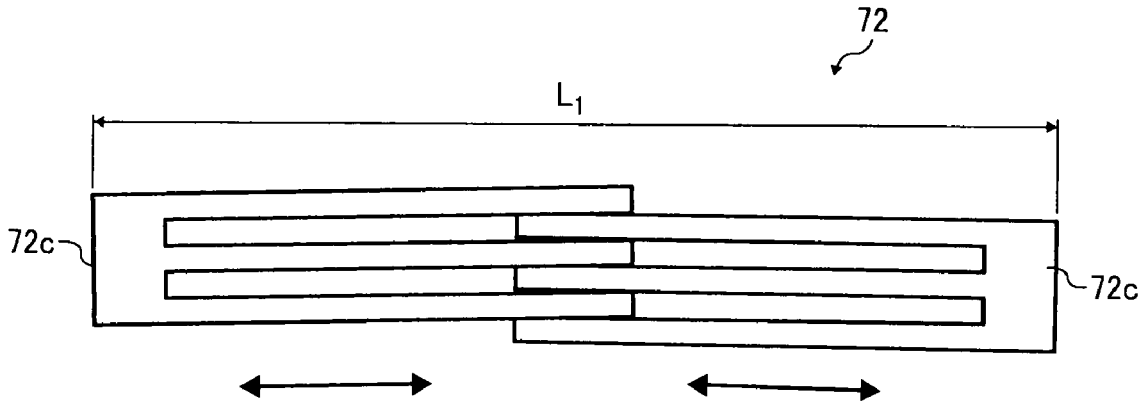
FIGS. 10A and 10B are plan views of the heating plate.
Figure 10B:
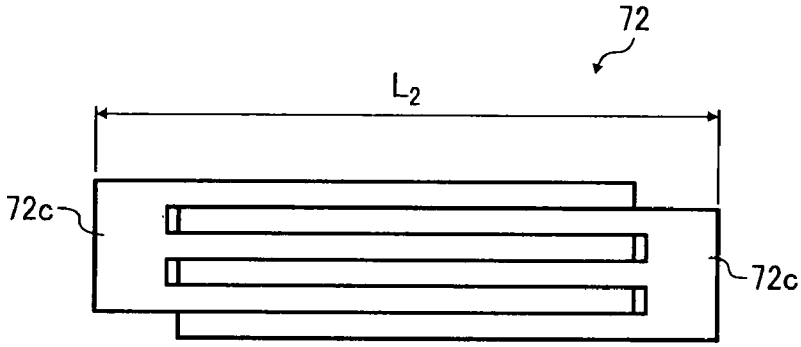

FIG. 8 is a schematic diagram showing a fixing device 60 according to a second embodiment of the present invention. The fixing device 60 can be used in the image forming apparatus shown in FIG. 1 instead of the fixing device 20. FIG. 9 is a schematic diagram of a heating plate 62 (contacting member) with a surface of a variable area facing the pressure roller 31 (pressure member). The heating plate 62 is divided into several symmetrical parts about a transport center with respect to a direction orthogonal to the transport direction. Heating plates 62*a* and 62*b* resulting from this dividing are coupled to an actuator 50 such as a solenoid and come into contact with and come away from a contacting surface of the pressure member. It is therefore possible to withdraw from the heating surface just the heating plate 62*b* with the actuator 50 and to reduce the surface area making contact with the pressure member. FIGS. 10A and 10B show a heating plate 72 that is a structural variant of the heating plates 22 and 62. The heating plate 72 (contacting member) includes two comb-shaped heating plates 72*c* aligned facing each other with respect to a direction orthogonal to the transport direction. The heating plates 72*c* can slid in a state where facing indents and projections of the combs combine with each other. As a result, as shown in FIG. 10B, it is possible to change lengths L1 and L2 in opposing directions of the contacting member where the two comb-shaped members are combined by changing the extent of meshing of the comb-shaped indents and projections. The width contacting with the pressure member can then be similarly changed.

The above structure is constructed for the transport direction. It is therefore possible to vary the nip width of the heating plate and the pressure member. When the recording medium is then thick and requires a large amount of heat, it is possible to supply more heat to the recording medium by broadening the nip width.

Further, the contacting width of the pressure member and the contacting member is varied so as to match with the width of the recording medium transported to the fixing device. With such a configuration, unnecessary heating at positions where the recording medium is not transported can be prevented.

It is also possible to heat and apply pressure to the width portion of a recording medium in a reliable manner even in cases where the contacting width is slightly greater than the recording medium width so as to cause slipping during transport of the recording medium.

With recording media such as envelopes, the sides are folded over and it is possible for the contacting width after varying of the pressure member and the contacting member to be smaller than the recording medium contacting width.

The contacting width after varying of the pressure member and the contacting member can also match with a width of a toner image of the fixing device. In this case, only the width of the toner image transferred to the recording medium is heated and the power consumed can be reduced.

It is also possible to reliably fix the toner image even when the contacting width is slightly larger than the toner image width so that slips in transporting of the recording medium occur.

Figure 11A:
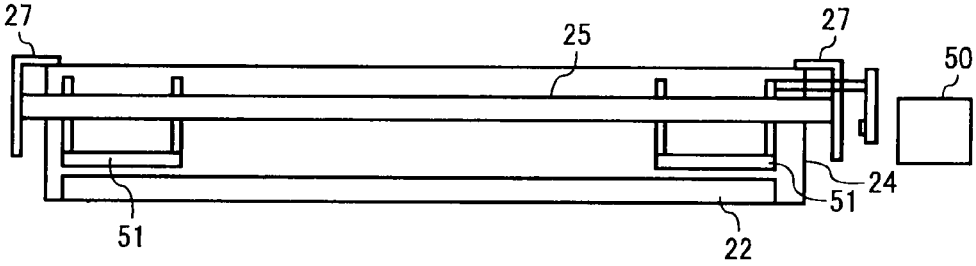
FIGS. 11A, 11B, and 11C are schematic diagrams where a mask member that selectively blocks heat from the heating unit is provided between the contacting member and the heating unit.
Figure 11B:
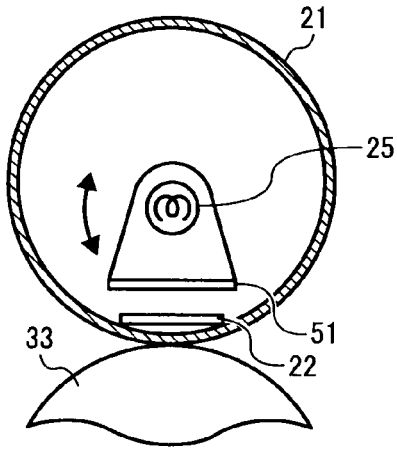
Figure 11C:
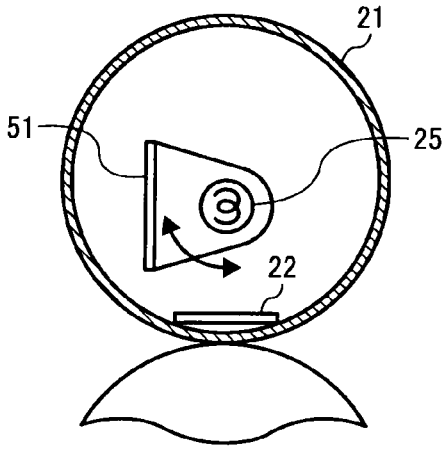

As shown in FIG. 11, one or more mask members 51 that selectively blocks heat from the heating plate 22 (contacting member) can be provided between the heating plate 22 and the infra-red heater 25 (heating member). The mask members 51 are provided symmetrically about a center of transport between the heating plate 22 and the infra-red heater 25. The mask members 51 can then be selectively removed to an escape position with the actuator 50. When the recording medium transported to the fixing device is small-sized, it does not pass over the end portions of the heating plate 22. The mask members 51 are therefore positioned so as to cover the parts where paper does not pass and heating of the end portions of the heating plate 22 can be avoided. Conversely, when the paper is big-sized, the mask members 51 are moved to the evasion position so that the whole of the heating plate 22 is heated by the infra-red heater 25.

It is also possible to increase the heating efficiency by allowing heat to flow at unmasked portions by using a reflecting member at the mask member and reflecting heat from the heating member using the reflecting member.

The heating efficiency can also be increased by using a heat blocking member at the mask portion and blocking the flow of heat from the heating member to the mask member so as to reduce the amount of heat flowing to the mask member.

As explained above, the infra-red heater 25 can be inserted into and detached from the fixing device 20 (or 60) in a state where the heating plate 22 (or 72) constituting a nip section heated by the infra-red heater 25 is in contact with the pressure roller 31 via the fixing film 21. The fixing device 20 (or 60) therefore has a shorter start-up time and improved ease of maintenance of the infra-red heater 25 with a comparatively simple and straightforward structure.

The pressure roller 31 in the fixing device 20 (or 60) can be replaced with a pressure belt or a pressure pad. It is also possible in this case to obtain the same results as obtained for the first embodiment in this case also.

The fixing device of the present invention has a flexible fixing member that heats and fuses a toner image, a contacting member that makes contact with a pressure member via the fixing member, fixed within the fixing member so as to form a nip section, and a heating unit that heats the contacting member. A surface area of a surface of the contacting member facing the pressure member is variable. It is therefore no longer necessary to have a contacting member at parts other than portions requiring heating where not paper passes through. Parts where no paper passes through can therefore be prevented from rising in temperature.

Further, the contacting member is separated into parts that can be moved to make contact with and be moved away from the pressure member. The area of the surface making contact with the pressure member can therefore be freely changed. It is then possible to remove contacting members at portions other than portions requiring heating where paper does not pass and to prevent rises in temperature at parts where paper does not pass.

It is then possible to remove contacting members at portions other than portions requiring heating where paper does not pass and to prevent rises in temperature at parts where paper does not pass by making the contacting member freely expandable and contractible and by making it possible to freely change the surface area of the surface making contact with the pressure member.

It is also possible to remove contacting members at portions other than portions requiring heating where paper does not pass and to prevent rises in temperature at parts where paper does not pass by making it possible to change the width of the contacting member in a lateral direction with respect to the transport direction.

It is further possible to control the width of the nip with respect to the pressure member of the contacting member by making the length of the contacting member variable with respect to the carrier direction. It is then possible to apply heat and pressure in line with the recording medium being transported.

The extent to which the contacting member is varied is decided in line with the width of the recording medium. Heating by the contacting member and the heating range can therefore be controlled and it is then possible to remove contacting members at portions other than portions requiring heating where paper does not pass and to prevent rises in temperature at parts where paper does not pass.

The extent of varying the contacting member is decided in line with the width of the toner image. The contacting member is therefore no longer required at parts other than portions transferring a toner image that require heating where paper does not pass.

It is then possible to make the amount of heating and extent of pressure applied in line with the transported recording medium by deciding the width of the nip according to thickness information for the recording medium.

The moveable position of the contacting member is decided according to the width of the recording medium. It is then possible to ensure the necessary amount of heating and pressure even when a recording medium transported to the fixing device slips in a lateral direction during transport.

Moveable positions of the contacting member are decided to be shorter than the width of the recording medium. Ease of transportation can also be improved by preventing heat and pressure from being applied to the ends of media having a shape bent at the sides such as when the recording media transported to the fixing device are envelopes.

The moveable position of the contacting member is decided to be longer than the width of the toner image. It is then possible to ensure the necessary amount of heating and pressure without failures occurring due to heating and pressure even when a recording medium transported to the fixing device slips in a lateral direction during transport.

A mask member that selectively blocks heat from the heating unit is provided between the contacting member and the heating unit. It is therefore possible to selectively change the range of heating from the heating body. It is then possible to remove contacting members at portions other than portions requiring heating where paper does not pass and to prevent rises in temperature at parts where paper does not pass.

The mask member also has a reflecting member. It is possible to increase the heating efficiency by having heat flowing to unmasked sections be reflected by the reflecting member.

The mask member can also be a heat-blocking member. It is then possible to increase the heating efficiency because the amount of heat flowing to the mask member made from heat blocking material can be reduced.

The present invention thus eliminates contacting members at non-paper-feed portions other than portions that require heating and prevents increases in temperature at non-paper-feed portions.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device, comprising:

a flexible fixing member that heats and fuses a toner image to a recording medium, the fixing member having a hollow portion;

a pressure member that is in pressure contact with the fixing member;

a contacting member that makes contact with the pressure member via the fixing member and that is arranged in the hollow of the fixing member; and a heating member configured to heat the contacting member, wherein the heating member is disposed so as to be capable of being inserted into and detached from the hollow in a state where the contacting member makes contact with the pressure member via the fixing member, a surface area of a surface of the contacting member facing the pressure member is variable, and the contacting member is capable of freely expanding and contracting thereby making a surface area of the contacting member making contact with the pressure member via the fixing member being variable.

2. The fixing device according to claim 1, wherein the contacting member includes a plurality of contacting sub-members and each contacting sub-member is capable of moving so as to connect with and disconnect from the pressure member via the fixing member thereby making a surface area of the contacting member making contact with the pressure member via the fixing member being variable.

3. The fixing device according to claim 1, wherein a width of the contacting member in a direction orthogonal with a transport direction of the recording medium is variable.

4. The fixing device according to claim 1, wherein a length of the contacting member is variable with respect to a transport direction of the recording medium.

5. The fixing device according to claim 1, wherein a length of the contacting member is variable in line with the width of the recording medium.

6. The fixing device according to claim 5, wherein a length of the contacting member is variable so as to be longer than a width of the recording medium.

7. The fixing device according to claim 5, wherein a length of the contacting member is variable so as to be shorter than a width of the recording medium.

8. The fixing device according to claim 1, wherein a length of the contacting member is variable in line with the width of the toner image on the recording medium.

9. The fixing device according to claim 8, wherein a length of the contacting member is variable so as to be longer than a width of the toner image.

10. The fixing device according to claim 1, wherein a length of the contacting member is variable in line with a thickness of the recording medium.

11. The fixing device according to claim 1, further comprising:

a mask member that selectively blocks heat from the heating member the mask member disposed between the contacting member and the heating member.

12. The fixing device according to claim 11, wherein the mask member is a reflecting member.

13. The fixing device according to claim 11, wherein the mask member is an insulating member.

14. An image forming apparatus comprising a fixing device, the fixing device including:

a flexible fixing member that heats and fuses a toner image to a recording medium, the fixing member having a hollow portion;

a pressure member that is in pressure contact with the fixing member;

a contacting member that makes contact with the pressure member via the fixing member and that is arranged in the hollow of the fixing member; and a heating member configured to heat the contacting member, wherein:

the heating member is disposed so as to be capable of being inserted into and detached from the hollow in a state where the contacting member makes contact with the pressure member via the fixing member, a surface area of a surface of the contacting member facing the pressure member is variable, and the contacting member is capable of freely expanding and contracting thereby making a surface area of the contacting member making contact with the pressure member via the fixing member being variable.

15. A fixing method implemented in a fixing device for fixing a toner image to a recording medium, the fixing device including a flexible fixing member that heats and fuses a toner image to a recording medium, the fixing member having a hollow portion; a pressure member that is in pressure contact with the fixing member; a contacting member that makes contact with the pressure member via the fixing member and that is arranged in the hollow of the fixing member; and a heating member configured to heat the contacting member, the fixing method comprising:

disposing the heating member so as to be capable of being inserted into and detached from the hollow in a state where the contacting member makes contact with the pressure member via the fixing member, and adjusting a surface area of a surface of the contacting member facing the pressure member by at least one of expanding and contracting the contact member, thereby making a surface area of the contacting member making contact with the pressure member via the fixing member variable.

* * * * *